United States Patent [19]

Bernd et al.

[11] Patent Number: 4,943,212

[45] Date of Patent: Jul. 24, 1990

[54] MEANS FOR FEEDING FLUID INTO A PRESSURE CONDUIT

[75] Inventors: Hubert Bernd; Pierre Heiby, both of Lohr/Main; Alfred Sitter, Gemünden, all of Fed. Rep. of Germany

[73] Assignee: Mannesman Rexroth GmbH, Fed. Rep. of Germany

[21] Appl. No.: 275,438

[22] Filed: Nov. 23, 1988

[30] Foreign Application Priority Data

Nov. 27, 1987 [DE] Fed. Rep. of Germany ..... 3740344

[51] Int. Cl.[5] ..... F04B 41/06

[52] U.S. Cl. ..... 417/7; 417/216

[58] Field of Search ..... 417/3, 4, 5, 6, 7, 216

[56] References Cited

U.S. PATENT DOCUMENTS

| | | | |
|---|---|---|---|
| 3,060,858 | 10/1962 | Shoosmith | 417/3 |
| 3,229,639 | 1/1966 | Hignutt et al. | 417/6 |
| 4,259,038 | 3/1981 | Jorgensen et al. | 417/5 |
| 4,496,289 | 1/1985 | Heiser et al. | 417/222 |

FOREIGN PATENT DOCUMENTS

| | | | |
|---|---|---|---|
| 0076282 | 5/1982 | Japan | 417/7 |
| 0140587 | 8/1982 | Japan | 417/5 |

*Primary Examiner*—Leonard E. Smith
*Assistant Examiner*—David W. Scheuermann
*Attorney, Agent, or Firm*—Harness, Dickey & Pierce

[57] ABSTRACT

Connected to a pressure conduit are a plurality of fixed displacement pumps and a variable displacement pump which are connectable and disconnectable in accordance with the amount of fluid withdrawn. The maximum delivery rate of the variable displacement is greater than the delivery rate of each fixed displacement pump. For the minimum and maximum delivery rate of the variable displacement pump two switching points are defined at each of which a fixed displacement pump is connected or disconnected. This gives a reliable fluid supply of the pressure conduit without any danger of erroneous switchings.

15 Claims, 4 Drawing Sheets

Figure 8:
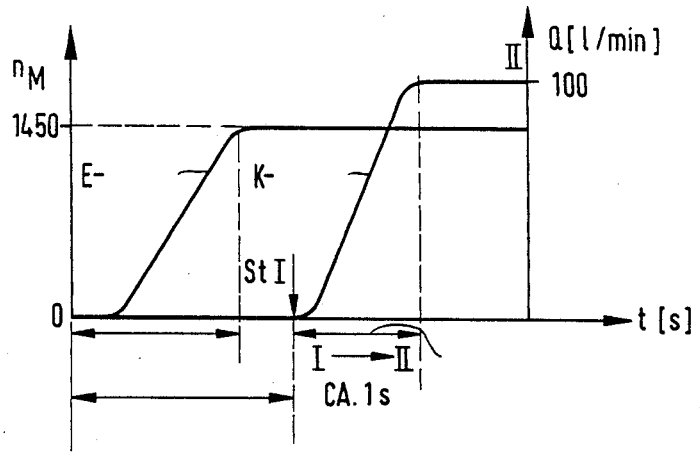

Fig.1
PRIOR ART
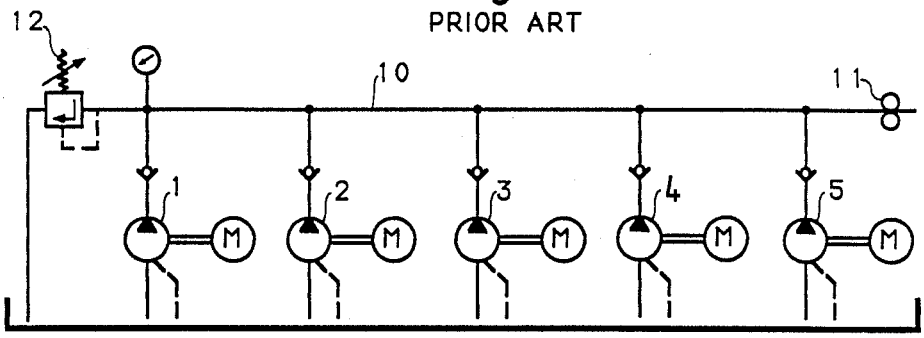
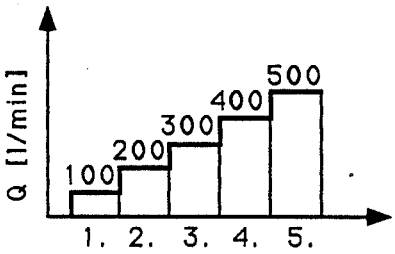
Fig.2
PRIOR ART
Fig.3
PRIOR ART
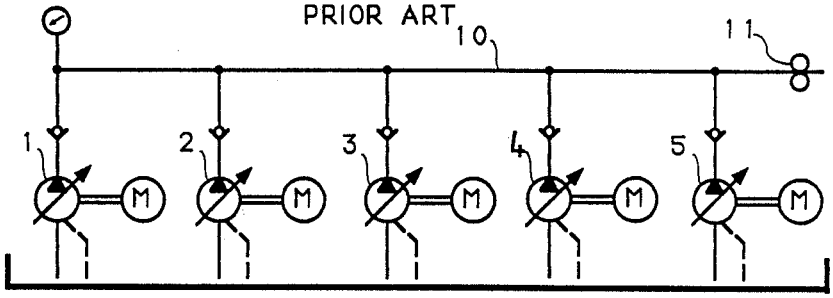
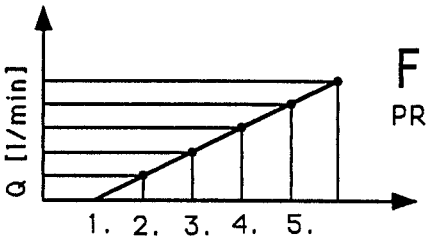
Fig.4
PRIOR ART

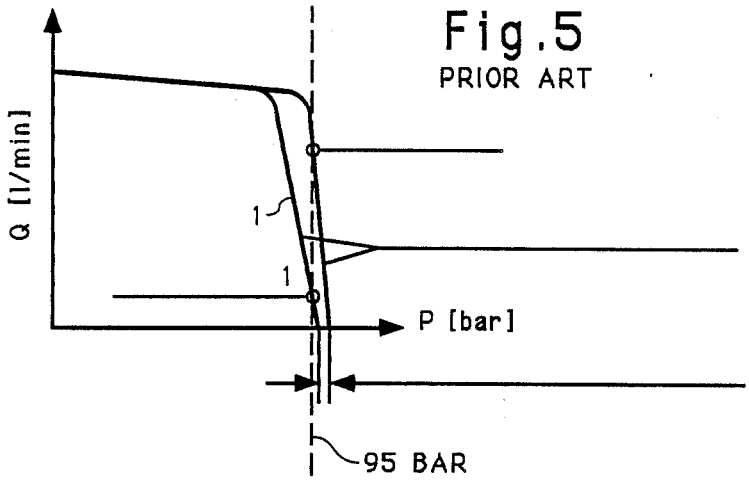
Fig.5
PRIOR ART
Fig.6
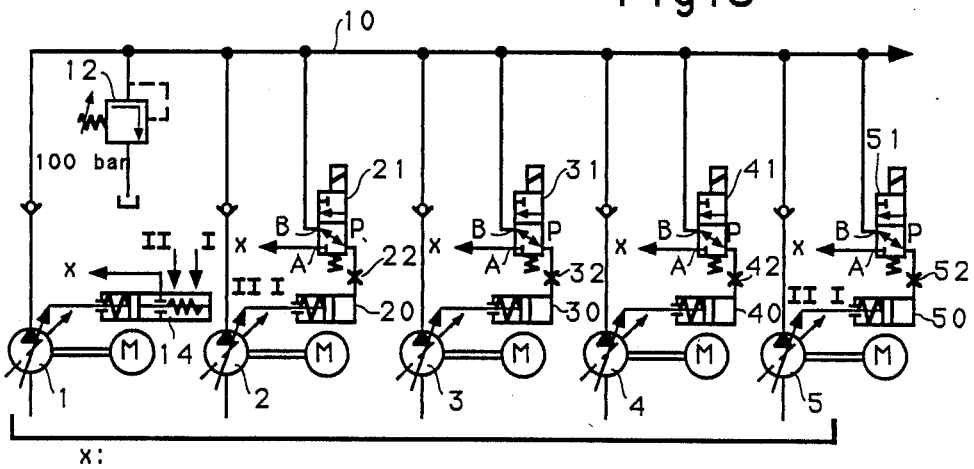
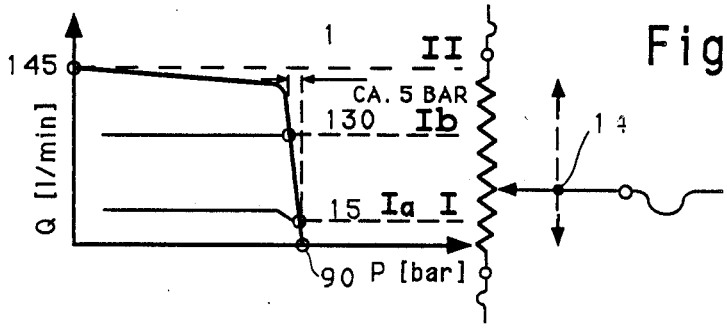
Fig.7

Fig. 11
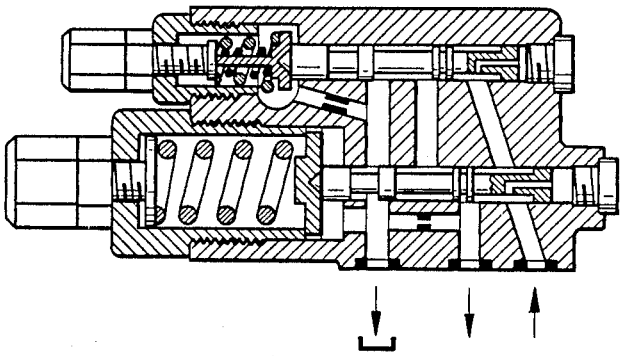
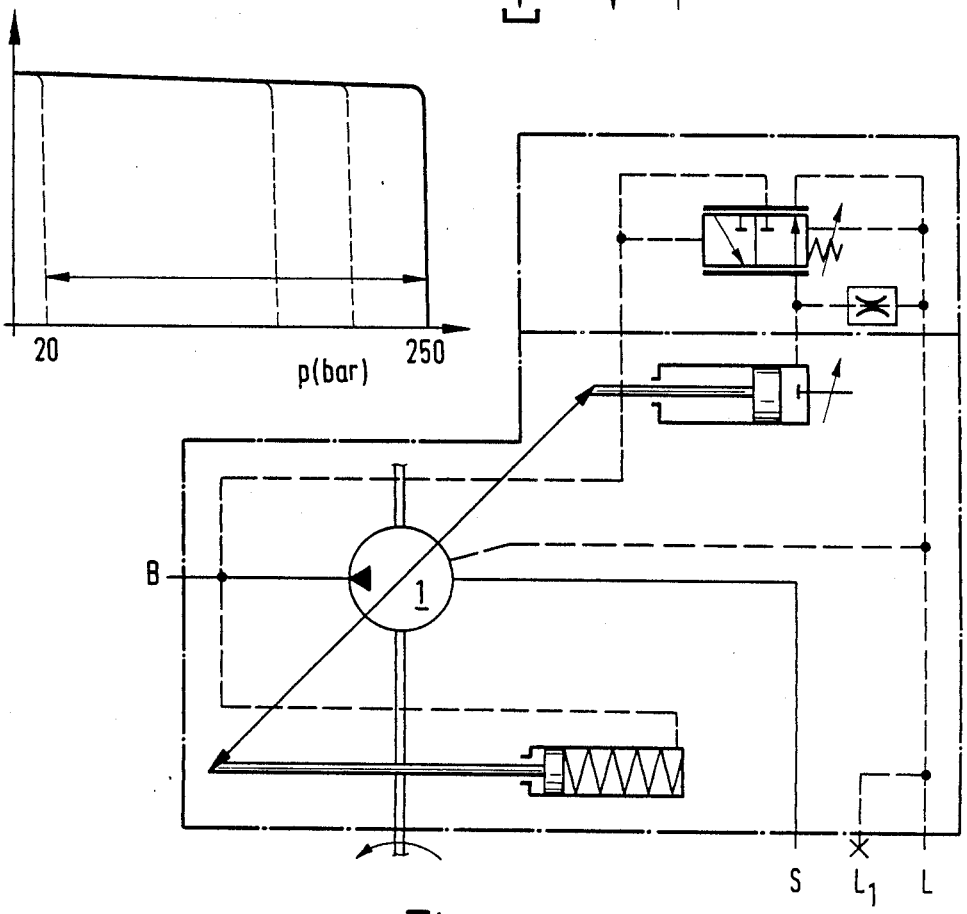
Fig. 10

MEANS FOR FEEDING FLUID INTO A PRESSURE CONDUIT

The invention relates to a means for feeding fluid into a pressure conduit in accordance with the preamble of claim 1.

In known constructions central fluid supplies are constructed both with fixed displacement and with variable displacement pumps. However, both constructions have their disadvantages.

FIG. 1 shows a construction with fixed displacement pumps. The pressure in the central conduit 10 is to be kept constant, for example, within 3 to 5 bar of a predetermined valve. The individual fixed displacement pumps are connected or disconnected depending upon the requirement in accordance with the diagram in FIG. 2 with their E motors M. The connection or disconnection is governed by a flow meter 11:

If the flow meter 11 reports a fluid requirement of 0 to 95 l/min then only the first stage, i.e. the fixed displacement pump 1, is connected in. If the requirement increases then the second stage is switched in. Above 195 l/min requirement the third stage is connected in. If less than for example 95 l/min is required for a short time the flow meter 11 keeps only the first stage connected. The loss of 5 l/min, which is led off via the pressure limiting valve 12 set at for example 95 bar, is relatively small.

If however the consumption rises briefly beyond 95 l/min the second stage is switched on and a relatively high loss of about 100 l/min (at 95 bar) occurs which is led off in this case as well via the pressure-limiting valve 12 (FIG. 2).

The disadvantages of this system reside in that the pumps are switched on or off corresponding to the starting-up times of the E motors and thus introduce pressure surges into the central conduit 10 because the starting-up time of the E motors is relatively small. The loss (heat) can depending on the consumption and stage switched on exceed the magnitude of a complete stage (about 100 l/min for 95 bar). If for example 10 or more pumps must be switched the flow meter must indicate 1000 l/min and more but also less than 100 l/min. The display in the lower range is then usually inaccurate and leads to erroneous switchings.

A construction with variable displacement pumps is shown in FIG. 3 and the associated diagram in FIG. 4. In this case as well the pressure in the central conduit is to be held constant for example within 3 to 5 bar of a predetermined. The individual variable displacement pumps 1 to 5 are connected and disconnected depending on the requirement (cf. FIG. 4) with their E motor M. The connection or disconnection is governed by a flow meter 11. If the flow meter 11 reports a fluid requirement of 0 to 95 l/min then in this case as well only the first stage is connected. If the requirement increases the next stage is connected. Since these are variable control pumps all intermediate amounts are supplied by them even between the individual stages (100, 200, 300 l/min etc.). There is no loss via a pressure-limiting valve.

The disadvantages of this system are: all the pumps must have exactly the same zero stroke pressure (difficult adjustment) and the characteristic of the vertical branch must be the same for all pumps. If this is not the case the pumps deliver at different rates for the same pressure (e.g. for the required operating pressure of 95 bar). FIG. 5 shows that due to differently set zero stroke pressure and different characteristic inclined position a pump may not be able to reach the full delivery flow at all. If for example 10 or more pumps must be switched the flow counter must indicate 1000 l/min and more but also less than 100 l/min. The indication in the lower range is then usually inaccurate and leads to erroneous switchings.

If the pressure is to be kept substantially constant (e.g. within 3 to 5 bar of a predetermined valve) the switching over cannot come from the flow meter alone. The flow meter would allow the pressure to drop and only switch over when the full flow rate is reached.

Consequently, to maintain the pressure a pressure switch must also be provided which switches to the next higher stage when the pressure has dropped accordingly irrespectively of where the variable displacement pumps are "standing" and thus of which delivery they are producing. Now, by pure "chance" it may be that the pressure switch switches over when the pumps are delivering the maximum rate. This depends however on the tolerances in FIG. 5, how the pumps cooperate with each other.

The problem underlying the invention is to further develop the means of the type outlined at the beginning so that pressure surges in the conduit network and heat losses are avoided, that the connection disconnection of the pumps are simplified and that erroneous switchings are avoided.

Said problem is solved according to the invention by the features of claim 1. Advantageous further developments will be apparent from the subsidiary claims.

Figure 9:
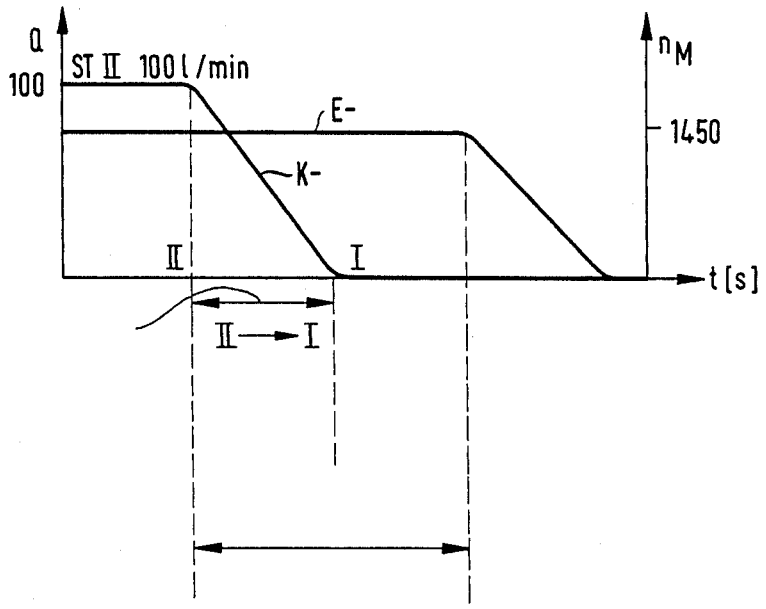

The cited prior art and an example of embodiment of the invention are shown in the drawings, wherein:

FIGS. 1 to 5 show schematic illustrations and diagrams of known constructions, FIG. 6 is a schematic illustration of an example of embodiment of the invention, FIGS. 7 to 9 show diagrams to explain the invention, In FIG. 6 the system consists of a variable displacement pump (0 stroke pump) 1 with E motor M and of for example four fixed displacement pumps 2, 3, 4 and 5 with respective E motors M. The variable displacement 1 is a zero stroke pump with a zero stroke pressure of 90 bar and permits regulation of the delivery rate between the positions I and II of the adjusting means from 0 to a maximum of 150 l/min. The fixed displacement pumps also operate up to 90 bar in two positions: in position I the delivery is 0 and in position II the maximum delivery of 100 l/min is reached. The fixed displacement pumps operate above 95 bar like zero stroke pumps between I and II.

In this case the pressure in the central conduit 10 is again to be held constant with a fluctuation-band between 3 to 5 bar.

The single variable displacement pump 1 in FIG. 6 is set to a zero stroke pressure of 90 bar. The maximum delivery volume 145 l/min is greater than the individual delivery volumes of each fixed displacement pump 2 to 5, which are 100 l/min in each case. The inclined disc of the variable displacement pump 1 operates between I (rate=zero) and II (rate=maximum 145 l/min) depending on the rate required in the central conduit 10 with a pressure between 90 and about 85 bar (dependent on the rate). An electrical pickup 14 at the variable displacement pump 1 indicates how the inclined disc is pivoted. The electrical voltage at the pickup 14 is proportional to the pump delivery rate. The pickup 14 thus indicates the instantaneous delivery rate.

If the pressure in the system does not rise beyond 90 bar the pumps 2 to 5 operate like fixed displacement pumps and deliver in the end position II the maximum amount in each case of 100 l/min. Each adjusting means 20, 30, 40, 50 of the fixed displacement pumps 2, 3, 4 and 5 has associated therewith a directional control valve 21, 31, 41, 51 which in the switch-on position shown connects each adjusting means to the central conduit 10 so that the fixed displacement pump is shifted by the actuating means into the position II.

If the directional control valve 21, 31, 41 and/or 51 is disconnected the inclined disc of the associated pump 2, 3, 4 and/or 5 assumes the position I. This means that the delivery rate=zero. The normal operation is always at position I or II and not at an intermediate position.

If the pressure in the central conduit 10 rises beyond 95 bar (trouble) then the zero stroke controller additionally provided on each of the pumps 2 to 5 comes into action.

The pump regulates itself automatically in accordance with the demand made.

Between each directional control valve and the pump adjusting cylinder there is also a switch time nozzle 22, 32, 42 and 52.

The system no longer contains a flow meter.

The entire system is further secured by a pressure-limiting valve 12 which is set to 100 bar. The protection should become effective only in the case of trouble, for example a pump does not switch off and the consumption drops.

The mode of operation of the system is as follows:

Firstly, all the pumps 1 to 5 are disconnected and are stationary. The E motor of the variable-displacement 1 is switched on and the inclined disc then pivots out of the position II in the direction I. The inclined disc comes to a standstill in the position corresponding to the delivery volume which is withdrawn from the central conduit 10 on starting up.

FIG. 7 shows the working range of the variable displacement pump 1 on the vertical characteristic branch: the variable displacement pump operates alone initially between 0 and 129 l/min.

As long as the variable displacement pump 1 is operating alone the switching point Ia plays no part. If however the switching point Ib is reached at the electrical pickup 14, i.e. the pump delivers 130 l/min, the fixed displacement pump 2 is automatically switched in.

The switching in of the fixed displacement pump 2, 3, 4 or 5 takes place such that firstly the E motor is switched on and the pivot disc held in position I (delivery=zero) by disconnection of the associated directional control valve. Only after the E motor has reached its final speed is the directional control valve disconnected and the pivot disc pivots in the direction of the position II into the maximum delivery. The pivoting from position I to position II takes place in the time defined by the associated switching time nozzle, for example in one second. The pump 2, 3, 4 or 5 then assumes the fixed position II and then delivers in each case 100 l/min into the central conduit 10. This operation is illustrated in FIG. 8.

The switching in of the fixed displacement pump 2, 3, 4 or 5 takes place as described above in that at the pickup 14 of the control pump 1 the position Ib (corresponding to 130 l/min) has been reached. Whereas the connected fixed displacement pump delivers from 0 to 100 l/min within about 1 second into the central conduit 10 the variable displacement pump must swing back during this time through 100 l/min, i.e. to 30 l/min. Since the variable displacement pump 1 has control times beneath 1 second it can easily follow the switching-on operation of a fixed displacement pump by regulating back.

After the first fixed displacement pump has been connected the changeover point Ia at the pickup 14 of the variable displacement pump 1 is also sharply defined. Since during the connection operation described above the variable displacement pump 1 must pivot back it must not reach the lower switching point Ia because it would otherwise again initiate a disconnection. This is also not the case because it pivots back to 30 l/min whilst the lowermost disconnection point is at about 15 l/min.

If now the consumption in the system drops the variable displacement pump pivots in the direction of position Ia. As soon as the position Ia (15 l/min) is reached at the electrical pickup 14 a fixed displacement pump is disconnected. The disconnection takes place in accordance with FIG. 9.

Firstly the fixed displacement pump is pivoted back from position II to position I. Thereafter, via a timing member the E motor is disconnected.

As soon as a fixed displacement pump of 100 l/min is switched away the variable displacement pump must run up from 15 l/min (lower switching point) by 100 l/min, i.e. to 115 l/min. During this operation the upper switching point of 130 l/min must not be reached.

The advantages of this system are:

(a) Due to the slow influenceable connection and disconnection of the fixed displacement pumps and the simultaneous follow-up control of the variable displacement pump pressure surges in the conduit network are prevented.

(b) The system operates as regulating system. Heat losses via the pressure-limiting valve only occur in the event of trouble.

(c) A flow meter is not necessary because the consumption is indicated at the electrical pickup of the variable displacement pump 1 and fixed displacement pumps are connected and disconnected. Since only one electrical pump regulator is present only a simple electrical interconnection is necessary also as regards the function (connection and disconnection).

The problem of small frequently inaccurately indicated flow rates is also eliminated because of course no flow meter is required.

(d) If a fixed displacement pump is connected or disconnected then 100 l/min is clearly connected or removed. Each pump is fully utilized as regards its delivery volume. This was not the case with variable displacement pumps. The exact zero stroke setting necessary for variable displacement pumps is likewise dispensed with.

Disturbances:

If trouble occurs in a fixed displacement pump then this trouble must be detected, the E motor disconnected and the disturbance indicated. If trouble occurs in the variable displacement pump 1 this trouble must also be detected and the E motor disconnected. The trouble must be indicated. At the same time all the E motors and pumps of 2 to 5 must start simultaneously in accordance with FIG. 7. Since due to the failure of the pump 1 the connection and disconnection is disturbed the pumps 2 to 5 operate simultaneously as zero stroke pumps and adjust themselves in accordance with the necessary consumption.

Manual connection and disconnection:

As soon as the upper switching point Ib or the lower switching point Ia is reached as shown in FIG. 7 a signal shows the next manual connection and disconnection. The operation of connecting or disconnecting is then however always in accordance with FIG. 8 and FIG. 9.

In the claims the variable displacement pump is designated as master pump and the fixed displacement pumps as switching pumps.

We claim:

1. Means for feeding fluid into a pressure conduit while maintaining a substantially constant pressure independent of fluid throughput, the fluid feeding means comprising:

a master pump of variable delivery rate dischargeable into said pressure conduit, said master pump having an upper switching point and a lower switching point, both switching points predetermined between a minimum master pump delivery rate and a maximum master pump delivery rate; and at least one variable displacement switching pump dischargeable into said pressure conduit, said at least one switching pump operable in either one of two switching pump end positions wherein the first end position corresponds to a minimum switching pump delivery rate of zero, and a second end position corresponds to a maximum switching pump delivery rate, said at least one switching pump switchable from one end position to another when a master pump delivery rate coincides with one of said switching points.

2. Means according to claim 1 wherein said at least variable displacement switching pump comprises a plurality of variable displacement switching pumps.

3. Means according to claim 2, characterized in that when the upper switching point of the master pump is reached a respective switching pump is connected to the pressure conduit and operates at the maximum switching pump delivery rat corresponding to the second end position, and when the second lower switching point is reached the respective switching pump is disconnected from the pressure conduit and operates at the zero delivery rate corresponding to the first end position.

4. Means according to claim 2, characterized in that a master pump delivery rate corresponding to the difference between the master pump delivery rates at the two switching points is substantially equal to each maximum switching pump delivery rate.

5. Means according to claim 2, characterized in that the master pump is in zero operation in that the two switching points are at the same pressure value but at different displacement values.

6. Means according to claim 2, characterized in that the delivery rate of the master pump is detected by a measuring pickup and a signal from the measuring pickup serves to activate a respective switching pump.

7. Means according to claim 6, characterized in that the measuring pickup is a pivot angle pickup.

8. Means according to claim 7, characterized in that an adjustment means for adjusting pivot angles of the switching pumps is activatable by the measuring pickup signal.

9. Means according to claim 8 characterized in that a directional control valve is provided to effect selective connection of a respective switching pump to a zero stroke controller or to the pressure conduit in response to the signal.

10. Means according to claim 2, characterized in that a delay means is provided for delaying the pivoting of the variable displacement switching pumps between the two ends.

11. Means according to claim 10, characterized in that the delay means is a throttle.

12. Means according to claim 11, characterized in that on connection of a respective switching pump deflection thereof from zero stroke to maximum delivery rate is delayed until after runup of a switching pump drive motor.

13. Means according to claim 9, characterized in that switching on of a switching pump drive motor and actuating of the directional control valve for switching pump adjustment are coupled.

14. Means according to claim 13, characterized in that on disconnecting a respective switching pump, disconnection of the drive motor after pivoting back of the switching pump to zero stroke is delayed.

15. Means according to claim 2, characterized int hat the switching pumps are connected in zero stroke operation to a zero controller which is set to a higher pressure than a zero stroke controller of the master pump.

* * * * *

UNITED STATES PATENT AND TRADEMARK OFFICE

CERTIFICATE OF CORRECTION

PATENT NO. : 4,943,212

DATED : July 24, 1990

INVENTOR(S) : Bernd, et al

It is certified that error appears in the above-identified patent and that said Letters Patent is hereby corrected as shown below:

On the Title Page, under "Assignee", "Mannesman" should be --Mannesmann--

Column 5, line 43, Claim 3, "rat" should be --rate--.

Column 6, line 44, Claim 15, "int hat" should be --in that--.

Column 6, line 46, Claim 15, after "zero" insert --stroke--.

Signed and Sealed this

Twenty-third Day of February, 1993

*Attest:*

STEPHEN G. KUNIN

*Attesting Officer*

*Acting Commissioner of Patents and Trademarks*